US008308027B2

(12) United States Patent
Law et al.

(10) Patent No.: US 8,308,027 B2
(45) Date of Patent: Nov. 13, 2012

(54) AUTOMATIC SOAP DISPENSER WITH TOP-SIDE MOTOR AND METHODS

(75) Inventors: Brian Law, Leicester (GB); David Pritchett, Leicestershire (GB); Simon Ingram, Northhampton (GB)

(73) Assignee: Regent Medical Center (GB)

( * ) Notice: Subject to any disclaimer, the term of this patent is extended or adjusted under 35 U.S.C. 154(b) by 395 days.

(21) Appl. No.: 12/628,563

(22) Filed: Dec. 1, 2009

(65) Prior Publication Data

US 2011/0127290 A1 Jun. 2, 2011

(51) Int. Cl.

| | |
|---|---|
| ***B67D 1/00*** | (2006.01) |
| ***B67D 7/56*** | (2010.01) |
| ***B67D 7/06*** | (2010.01) |
| ***B65D 88/54*** | (2006.01) |
| ***G01F 11/00*** | (2006.01) |
| ***B67B 7/00*** | (2006.01) |

(52) U.S. Cl. ..... 222/52; 222/154; 222/181.3; 222/333; 222/1

(58) Field of Classification Search ..... 222/181.3, 222/190, 52, 63, 333, 154, 23, 504, 1
See application file for complete search history.

(56) References Cited

U.S. PATENT DOCUMENTS

| | | | | |
|---|---|---|---|---|
| 3,563,418 | A | | 2/1971 | Hahn |
| 4,238,056 | A | | 12/1980 | Tucker et al. |
| 4,722,372 | A | | 2/1988 | Hoffman et al. |
| 4,946,070 | A | | 8/1990 | Albert et al. |
| 4,967,935 | A | | 11/1990 | Celest |
| 5,105,992 | A | | 4/1992 | Fender et al. |
| 5,249,718 | A | | 10/1993 | Muderlak |
| 5,255,822 | A | * | 10/1993 | Mease et al. ..... 222/63 |
| 5,344,047 | A | | 9/1994 | Chen |
| 5,379,917 | A | | 1/1995 | Brown et al. |
| 5,411,177 | A | | 5/1995 | Blake, III |
| 5,445,288 | A | | 8/1995 | Banks |
| 5,452,823 | A | | 9/1995 | Palmer et al. |
| 5,492,247 | A | | 2/1996 | Shu et al. |
| 5,507,413 | A | | 4/1996 | Chen |
| 5,556,005 | A | | 9/1996 | Banks |
| 5,799,826 | A | * | 9/1998 | Brown et al. ..... 222/4 |
| 5,862,954 | A | | 1/1999 | Ehrensperger et al. |
| 5,960,991 | A | | 10/1999 | Ophardt |
| D417,111 | S | | 11/1999 | Polan |

(Continued)

FOREIGN PATENT DOCUMENTS

DE 3531385 3/1987

(Continued)

OTHER PUBLICATIONS

International Search Report and Written Opinion dated Mar. 4, 2011 in related Application No. PCT/IB2020/003067.

(Continued)

*Primary Examiner* — Kevin P Shaver
*Assistant Examiner* — Matthew Lembo
(74) *Attorney, Agent, or Firm* — Kilpatrick Townsend & Stockton LLP

(57) ABSTRACT

Embodiments of the present invention provide dispensers, and particularly automatic dispensers, and even more particularly, automatic soap dispensers for dispensing a foamed soap or another cleaning or antibacterial substance to a user's hands. The dispensers provide an internal working system that allows soap or foam to be dispensed from an inverted bottle via movement of an actuator.

17 Claims, 9 Drawing Sheets

U.S. PATENT DOCUMENTS

| | | | | |
|---|---|---|---|---|
| D418,344 | S | 1/2000 | De Winter | |
| 6,082,586 | A | 7/2000 | Banks | |
| 6,161,726 | A | 12/2000 | Parsons et al. | |
| 6,206,238 | B1 | 3/2001 | Ophardt | |
| 6,209,751 | B1 | 4/2001 | Goodin et al. | |
| D449,753 | S | 10/2001 | DeKoning et al. | |
| 6,325,245 | B1 | 12/2001 | Matthews | |
| 6,386,390 | B1 | 5/2002 | Tinker | |
| 6,409,050 | B1 | 6/2002 | Ophardt et al. | |
| 6,427,875 | B1 | 8/2002 | Hoang et al. | |
| D462,218 | S | 9/2002 | DeKoning et al. | |
| D463,186 | S | 9/2002 | Sorensen | |
| 6,467,651 | B1 | 10/2002 | Muderlak et al. | |
| 6,540,105 | B2 | 4/2003 | Dorman et al. | |
| 6,568,561 | B2 | 5/2003 | Studer et al. | |
| 6,601,736 | B2 | 8/2003 | Ophardt et al. | |
| 6,607,103 | B2 | 8/2003 | Gerenraich et al. | |
| 6,619,509 | B2 * | 9/2003 | DeKoning et al. | 222/183 |
| 6,651,851 | B2 | 11/2003 | Muderlak et al. | |
| 6,688,499 | B2 * | 2/2004 | Zhang | 222/413 |
| 6,695,174 | B2 | 2/2004 | Sorensen et al. | |
| 6,698,616 | B2 | 3/2004 | Hidle et al. | |
| 6,729,503 | B2 * | 5/2004 | DeKoning et al. | 222/183 |
| 6,758,372 | B2 | 7/2004 | Studer et al. | |
| 6,793,105 | B1 | 9/2004 | Ouyoung | |
| D502,033 | S | 2/2005 | Bruder | |
| D503,576 | S | 4/2005 | Reynolds et al. | |
| 6,971,549 | B2 | 12/2005 | Leifheit et al. | |
| 7,004,356 | B1 | 2/2006 | Sayers | |
| 7,021,494 | B2 | 4/2006 | Mazooji et al. | |
| D530,125 | S | 10/2006 | Vignot | |
| D537,667 | S | 3/2007 | van Haperen et al. | |
| 7,191,920 | B2 | 3/2007 | Boll | |
| 7,222,756 | B2 * | 5/2007 | Lo | 222/333 |
| D553,406 | S | 10/2007 | Vanlane et al. | |
| D553,407 | S | 10/2007 | Orgna et al. | |
| 7,278,554 | B2 | 10/2007 | Armstrong | |
| 7,281,643 | B2 | 10/2007 | Lin | |
| 7,303,099 | B2 | 12/2007 | Ophardt | |
| 7,308,990 | B2 | 12/2007 | Mazooji et al. | |
| 7,325,704 | B2 | 2/2008 | Kasting | |
| D568,660 | S | 5/2008 | Hodgson et al. | |
| D569,669 | S | 5/2008 | Nichols et al. | |
| D578,331 | S | 10/2008 | Tomic et al. | |
| D579,250 | S | 10/2008 | Cittadino et al. | |
| D584,551 | S | 1/2009 | Carlson | |
| D588,388 | S | 3/2009 | Crawford | |
| 7,527,178 | B2 * | 5/2009 | Lewis | 222/333 |
| 7,540,397 | B2 * | 6/2009 | Muderlak et al. | 222/400.5 |
| D604,545 | S | 11/2009 | Law et al. | |
| 7,621,426 | B2 * | 11/2009 | Reynolds et al. | 222/325 |
| 7,837,065 | B2 * | 11/2010 | Furner et al. | 222/52 |
| 2002/0070240 | A1 | 6/2002 | Dorman et al. | |
| 2002/0158085 | A1 | 10/2002 | Ophardt et al. | |
| 2002/0175182 | A1 * | 11/2002 | Matthews | 222/52 |
| 2002/0185500 | A1 | 12/2002 | Muderlak et al. | |
| 2003/0006246 | A1 | 1/2003 | Studer et al. | |
| 2003/0071058 | A1 | 4/2003 | Studer et al. | |
| 2003/0075565 | A1 | 4/2003 | Gerenraich et al. | |
| 2003/0226853 | A1 | 12/2003 | Hidle et al. | |
| 2004/0206772 | A1 | 10/2004 | Leifheit et al. | |
| 2004/0251271 | A1 | 12/2004 | Jackson et al. | |
| 2005/0006408 | A1 | 1/2005 | Ganzeboom | |
| 2005/0072805 | A1 | 4/2005 | Matthews | |
| 2005/0139612 | A1 | 6/2005 | Matthews et al. | |
| 2005/0247735 | A1 | 11/2005 | Muderlak et al. | |
| 2005/0247737 | A1 | 11/2005 | Armstrong | |
| 2005/0279783 | A1 | 12/2005 | Lo | |
| 2006/0011655 | A1 | 1/2006 | Ophardt | |
| 2006/0157500 | A1 | 7/2006 | Mazooji et al. | |
| 2006/0213924 | A1 | 9/2006 | Ophardt | |
| 2006/0237483 | A1 | 10/2006 | Ophardt | |
| 2006/0249538 | A1 | 11/2006 | Ophardt et al. | |
| 2006/0273114 | A1 | 12/2006 | Ophardt | |
| 2006/0278659 | A1 | 12/2006 | Lin | |
| 2007/0000941 | A1 | 1/2007 | Hadden et al. | |
| 2007/0023454 | A1 | 2/2007 | Ophardt | |
| 2007/0051748 | A1 | 3/2007 | Yates et al. | |
| 2007/0119873 | A1 | 5/2007 | Boll et al. | |
| 2007/0267444 | A1 | 11/2007 | de Buzzaccarini et al. | |
| 2008/0083786 | A1 | 4/2008 | Marin | |
| 2009/0140004 | A1 | 6/2009 | Scorgie | |

FOREIGN PATENT DOCUMENTS

| | | | |
|---|---|---|---|
| DE | 20320332 | | 6/2004 |
| DE | 10316692 | B3 | 11/2004 |
| EP | 468062 | A1 | 1/1992 |
| EP | 659380 | A1 | 6/1995 |
| EP | 0703831 | B1 | 4/1996 |
| EP | 0984715 | B1 | 3/2000 |
| EP | 1844690 | A2 | 10/2007 |
| EP | 1857535 | A1 | 11/2007 |
| JP | 4171287 | A | 6/1992 |
| JP | 9048479 | A | 2/1997 |
| JP | 2005211145 | A | 8/2005 |
| WO | WO 9012530 | A1 | 11/1990 |
| WO | WO 9401032 | A1 | 1/1994 |
| WO | WO 9526831 | | 4/1995 |
| WO | WO 9949769 | A1 | 3/1999 |
| WO | WO 0152710 | A1 | 7/2001 |
| WO | WO 0153002 | A1 | 7/2001 |
| WO | WO02094073 | | 11/2002 |
| WO | WO03005873 | | 1/2003 |
| WO | WO 03005873 | A1 | 1/2003 |
| WO | WO 2004052162 | A1 | 6/2004 |
| WO | WO 2004110234 | A2 | 6/2004 |
| WO | WO 2006134314 | A1 | 3/2006 |
| WO | WO 2006075196 | | 7/2006 |

OTHER PUBLICATIONS

U.S. Appl. No. 29/341,494, filed Aug. 6, 2009, Law et al.

* cited by examiner

AUTOMATIC SOAP DISPENSER WITH TOP-SIDE MOTOR AND METHODS

FIELD OF THE INVENTION

Embodiments of the present invention relate generally to dispensers. Specific embodiments relate to automatic dispensers that dispense soap or another cleaning or antibacterial substance upon recognition of a user's hand or other body part located in a dispensing region. Further embodiments relate to automatic soap dispensers or foamed soap dispensers. Such dispensers have an internal working system that allows soap or foam to be dispensed from an inverted bottle.

BACKGROUND

Traditional soap dispensers have a number of shortcomings. They generally sit on countertops or other surfaces near a faucet and may topple over or take up valuable space. They also typically require the user to press or pull an area on the dispenser in order to actuate the dispensing function, which contact can spread germs and generally be unsanitary. For example, in public restrooms, users may not wish to touch or pull a lever that others have repeatedly touched. In the health care arena, such contact can be even more concerning and unhygienic, raising health and contamination concerns.

One solution to the space problem has been to mount dispensers on or near hand-washing areas in order to save space. Dispensers designed for use in public venues (as opposed to domestic use) should provide a housing for the soap reservoir that can be closed, and in some instances, secured for sanitary reasons, but also easy enough for a custodian to change the soap reservoir when necessary.

One solution to the contact/hygiene problem presented by users pushing or pulling portions of the dispenser in order to dispense soap has been to design dispensers that automatically dispense a desired amount of soap, i.e., dispensers that function touch-free. This prevents the user from coming into contact with any part of the dispenser, and is particularly beneficial in a hospital or other health care setting, where the transmission of germs and bacteria is of particular concern. However, current designs of these dispensers also present some challenges and problems.

For example, some automatic dispensers fail to provide a consistent and accurate amount of soap upon each dispensing cycle. Some health regulations (e.g., various hospital jurisdictions) require that a certain amount of soap be dispensed per use. Additionally, some soap manufacturers recommend a specific amount of soap required for each use, e.g., as defined on a product label or package insert. It is thus accordingly desirable to have a reliable, consistent soap dispenser design that will automatically dispense a set amount of soap per use.

In other instances, dispensers are often designed to dispense a foamed soap. Foamed soaps tend to be easier to spread than unfoamed liquid and can cause less waste due to splashing or run-off because the foam has a higher surface tension than unfoamed liquid. Foamed soap also requires less liquid to create the same or comparable cleaning power than liquid soaps. Additionally, the use of foam can help save space by using a post-foaming soap gel or liquid that is stored in gel or liquid form, but converts to foam upon exiting the reservoir. For example, the foaming soap may be maintained in a pressurized container. In such pressurized systems, the pressure changes as the amount of soap in the reservoir reduces. This pressure change directly affects the amount of soap dispensed during a use. Such dispensers may not always release a consistent amount of soap without specialized systems designed to detect and monitor the amount of soap that is dispensed at each use.

Furthermore, many commercial soap dispensers are sold for use with specially configured bottles that are designed only to fit that specific company's soap dispensers. This can be expensive for the customer seeking to stock the soap dispenser because it must purchase soap bottles from the particular manufacturer whose dispensers are installed at its location. This can also limit choices, because the customer may wish to purchase a different brand or type of soap (e.g., at a different price point), but be prevented from doing so without refitting or replacing the currently-installed dispensers.

However, there are often space regulation requirements associated with wall-mounted dispensers. The dispensers often are restricted from extending a certain distance from the wall. This may present challenges to the dispenser designer because of the machinery often necessary in order to cause a soap dispenser to work automatically and/or to cause the dispenser to transform gel or liquid soap into a foam. As such, the dispensers often do need to be designed for use with specially shaped bottles so that the bottles will fit properly with the internal machinery of the dispenser. For example, one challenge presented to the current inventors was to design a dispenser that could house an appropriate motor and foam pump, but not extend a certain distance from the wall on which the dispenser is mounted due to health regulations. So rather than design a dispenser to be used with a specially-shaped bottle (e.g., one having an offset opening positioned at an edge of the bottle so that machinery can fit behind the bottle at the bottom of the dispenser), they sought to design a dispenser to be used with a pre-existing bottle (e.g., one having its opening positioned in line with the central axis of the bottle).

Additionally, if a customer wishes to change from liquid soap to foamed soap or vice versa, it must purchase a number of new dispensers, causing excess cost and inconvenience. One benefit of the designs described herein is that they may be used with or without foam pumps, with slight to minimal modifications, such that a foamed soap, a liquid soap, a gel, an anti-bacterial hand sanitizer, or any other appropriate substance may be dispensed from the dispenser.

It is thus desirable to provide an automatic soap dispenser that can be used with pre-existing soap bottles.

It is also desirable to provide a dispenser that can be easily opened and secured for replacement of the soap reservoir contained inside the dispenser.

It is further desirable to provide a dispenser configured to be mounted to a desired location.

It is also desirable to provide a dispenser configured to dispense a set amount of soap during each dispensing step. In some instances, the dispenser can be designed to dispense liquid soap, foamed soap, or other antibacterial solutions, such as hand sanitizer.

These and other advantages will become apparent from the following description and claims, taken in conjunction with the accompanying drawings.

BRIEF SUMMARY

Embodiments of the present invention provide dispensers, and particularly automatic dispensers, and even more particularly, automatic soap dispensers for dispensing a foamed soap to a user's hands. In one embodiment, there is provided a dispenser, comprising a front cover, a back plate, and an actuator, wherein the front cover and the back plate define a bottle containing space, wherein the back plate comprises a motor housing compartment at its upper portion and a bottle rest at its lower portion, wherein the actuator comprises a motor cooperating feature at its upper portion and a pump cooperating feature at its lower portion, wherein cooperation between a motor and the motor cooperating feature of the actuator causes movement of the actuator such that the pump cooperating feature of the actuator activates a pump. Embodiments also relate to a method for automatically dispensing a substance onto a user's hand, comprising providing a dispenser of the type described above (and herein), wherein the dispenser has a sensor configured to sense a user's hand below the dispenser, providing a bottle containing the substance to be dispensed, with an optional foam pump secured thereto, inverting the bottle; and positioning the bottle in the dispenser, such that when a user's hands are positioned below the dispenser, the sensor senses the presence of the user's hands and causes the dispenser to automatically dispense the substance thereon.

DETAILED DESCRIPTION

Embodiments of the present invention provide dispenser devices and methods, and specifically provide automatic dispensers. The dispensers are particularly suited for dispensing an antiseptic and/or antimicrobial skin cleanser to a user's hands. The product dispensed may be a liquid soap, a foamed soap, or a hand sanitizer (such as the type used for disinfecting hands without the use of soap and water). Embodiments of this invention are particularly suited for dispensing foamed soap to a user's hands, and those are the further embodiments described herein. It should be understood, however, that the various dispensers described may also be used for dispensing any appropriate product (such as shampoo and/or conditioner, body wash, dish washing detergent, laundry detergent, or any other gel or liquid or foamed product that is desired to be automatically dispensed) with slight or minor alterations to accommodate the specific desired product. For the sake of convenience, the dispenser may be referred to as a "soap dispenser" and the product dispensed may be referred to as "foamed soap" for the remainder of this application, but such references are in no way intended to be limiting of the structural features described.

Figure 1:
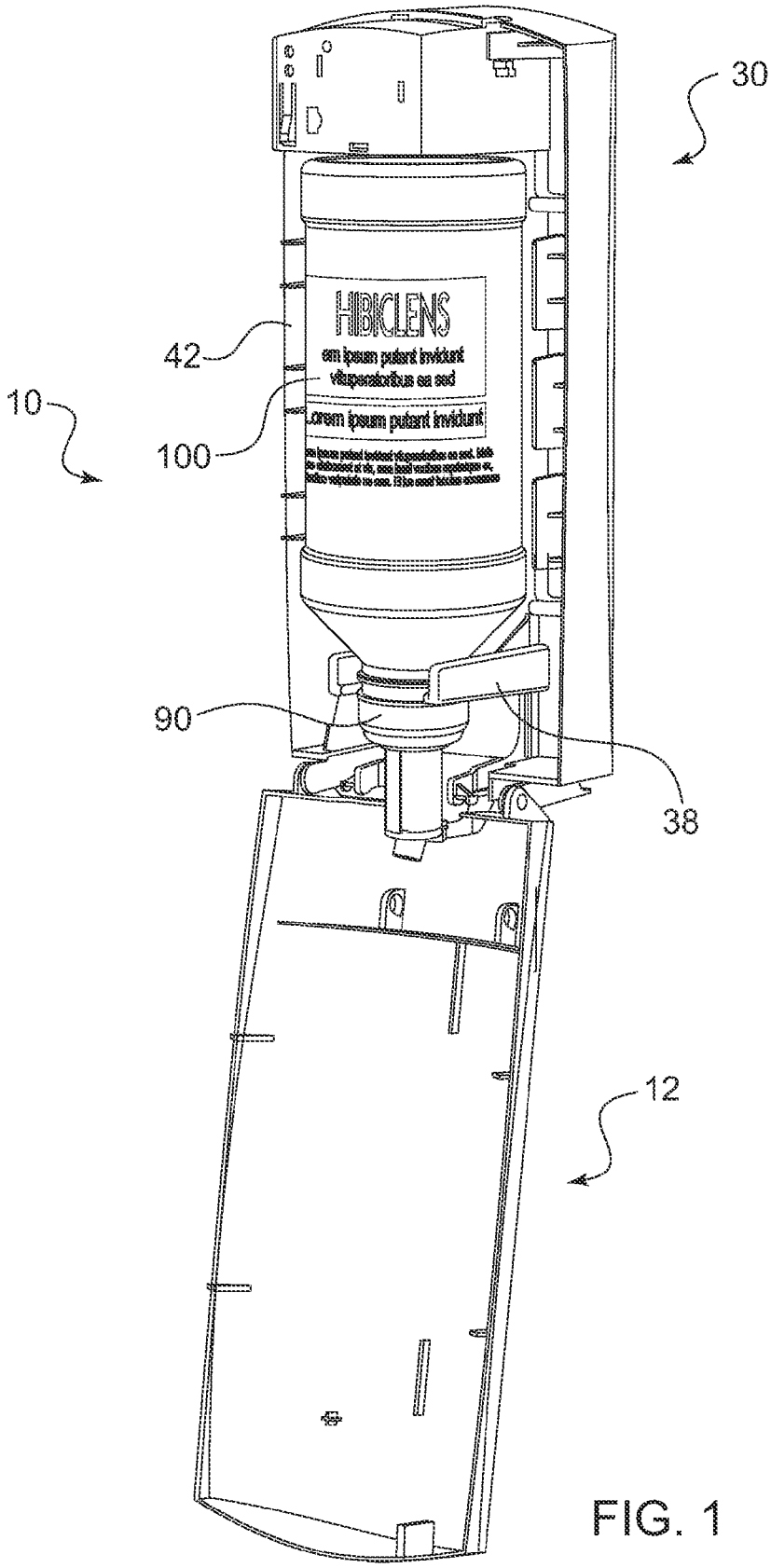
FIG. 1 shows a front perspective view of one embodiment of a soap dispenser in a hinged open position having a soap bottle/foam pump inserted therein.

As shown in FIG. 1, dispensers 10 according to various embodiments of the invention may have a hinged connection between a front cover 12 and a back plate 30. A soap bottle 100 having one or more dispensing attachments 90 may be inverted and positioned within a bottle containing space 42 of the dispenser 10.

Figure 4:
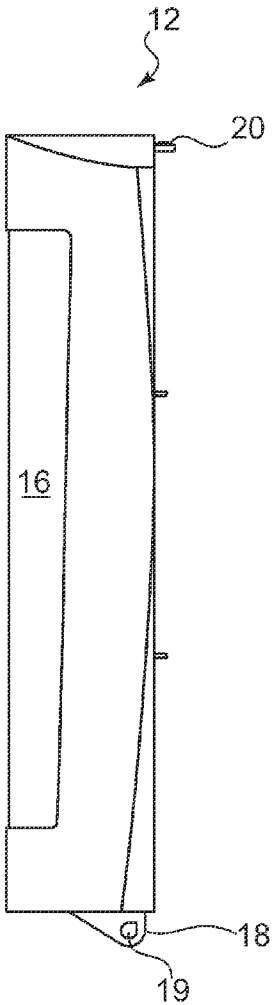
FIG. 4 shows a side plan view of the front cover of FIG. 2.
Figure 3:
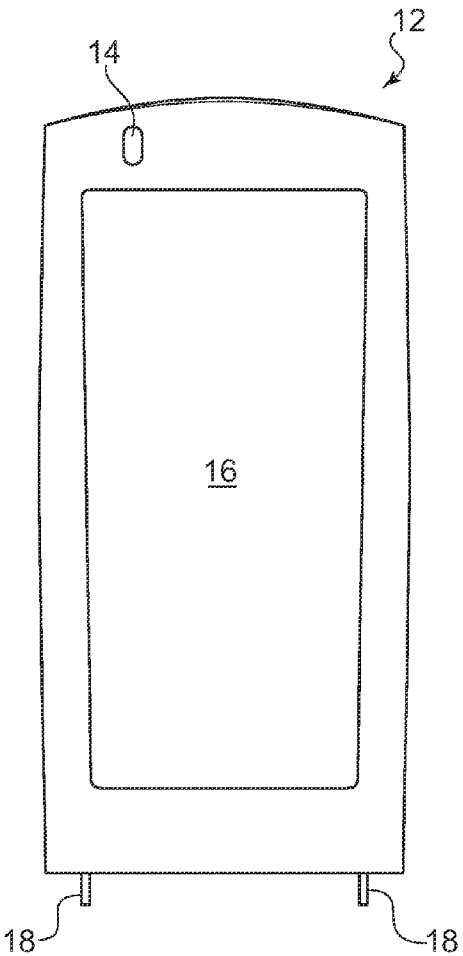
FIG. 3 shows a front plan view of the front cover of FIG. 2.
Figure 2:
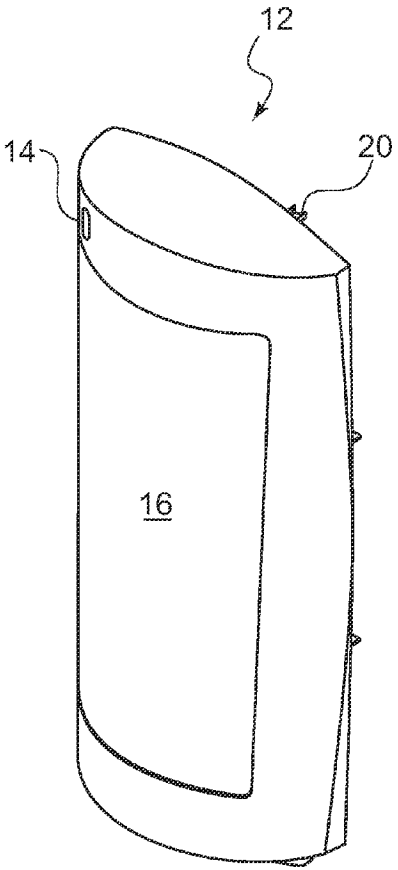
FIG. 2 shows a side perspective view of a front cover according to one dispenser embodiment.

As shown in FIGS. 2-4, a front cover 12 of the soap dispenser 10 is designed to attach or otherwise be secured to a back plate 30 in order to house a soap bottle. One of the advantages of the present design is that it includes a front cover 12 to cover the soap bottle inside this dispenser, providing a cleaner look to the dispenser 10 (as opposed to using only a back mount and inserting the soap bottle directly therein), as well as a front surface that is easy to wipe down and clean.

The front cover 12 and back plate 30 may be hingedly attached, snapped together, slid together via a track and tab system, magnetically attached, or attached by any other appropriate mechanism. In a particular embodiment, front cover 12 and back plate 30 are hingedly attached via hinge connectors. One example of such a hinge connector is illustrated by hinge connector 18 on FIGS. 3 and 4. Hinge connector 18 may receive a corresponding hinge connector feature on back plate 30, such that front cover 12 may rotate down and open in order for a soap bottle to be positioned against the back plate 30 as discussed below. Front cover 12 may then be rotated back up to close the dispenser 10. Although the hinge connector 18 is shown as located at the bottom of dispenser 10, it should be understood that the hinge feature may be located at the top of dispenser 10, the side of dispenser, or anywhere else along dispenser, as desired.

Front cover 12 is also shown as having a clear window 14, which is configured to allow a user to view one or more internal features of the soap dispenser. One use of clear window 14 may be to allow a user to see an LED light or other indicator inside the dispenser 10 so that the user will know that the dispenser 10 is properly powered. Although only one clear window 14 is shown, it should be understood that any number of clear windows may be provided. For example, a clear window may be provided along the side of the front cover 12 (or anywhere else) in order to allow a user to view the amount of soap remaining in a clear soap bottle or for any other appropriate purpose.

Figure 8:
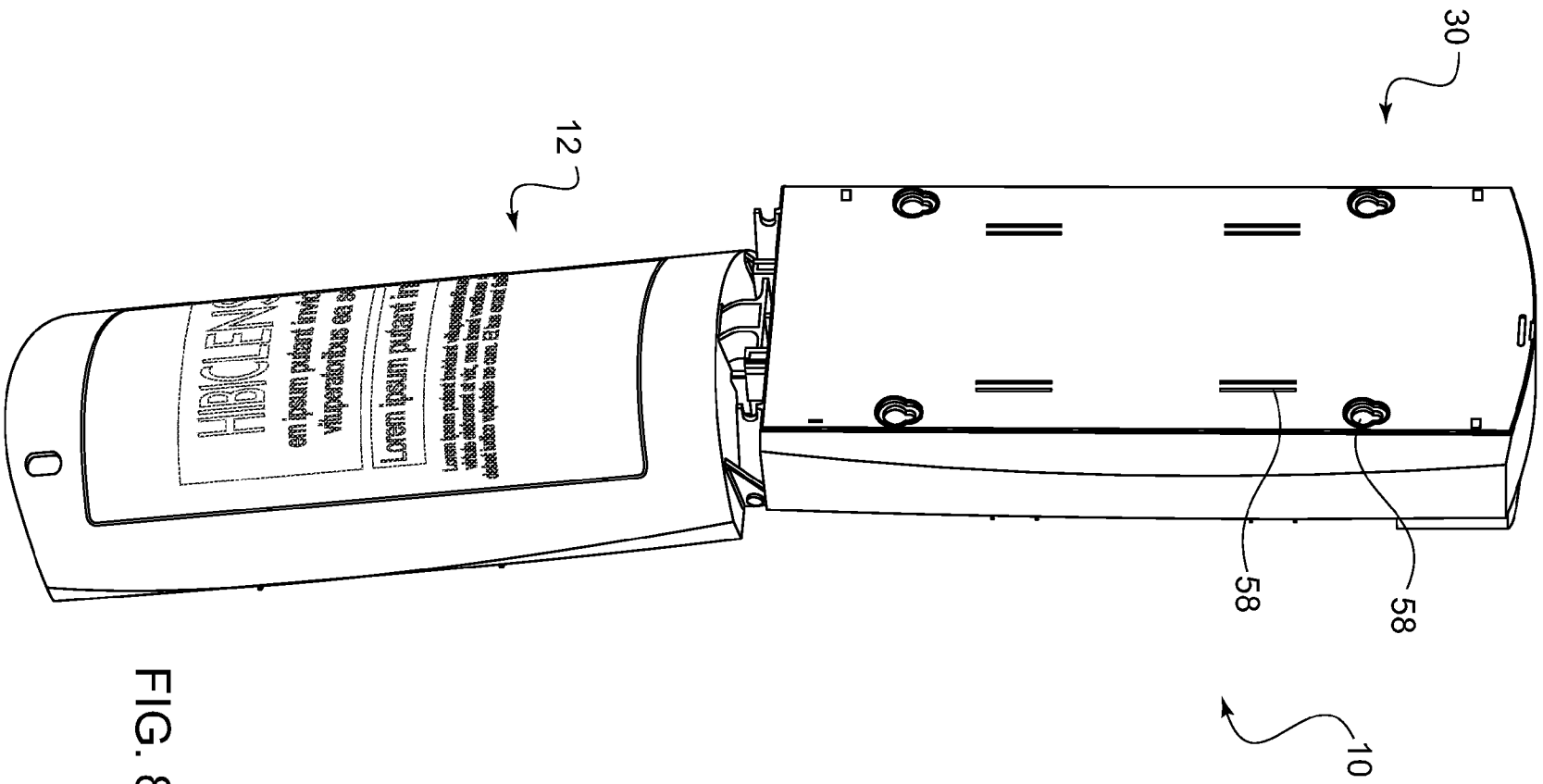
FIG. 8 shows a back perspective view of the soap dispenser of FIG. 1.

Front cover 12 is also shown as having a recessed area 16. Recessed area 16 is primarily configured to receive a soap bottle label so that the dispenser 10 clearly displays its contents. This is beneficial for the user to be aware of the soap brand housed within the dispenser 10, and it is also a health requirement in some jurisdictions. An example of a front cover 12 having a label secured thereto is shown in FIG. 8.

Front cover 12 may also have a lock connector 20. Lock connector 20 allows the front cover 12 to close securely against a corresponding lock connection of the back plate 30. Although the lock connector 20 is shown as located at the top of dispenser 10, it should be understood that the lock connector feature may be located at the bottom of dispenser 10, the side of dispenser, or anywhere else along dispenser, as desired. Generally, it should be positioned opposite the hinge connector 18, if a hinge connection between front cover 12 and back plate 30 is used.

Figure 7:
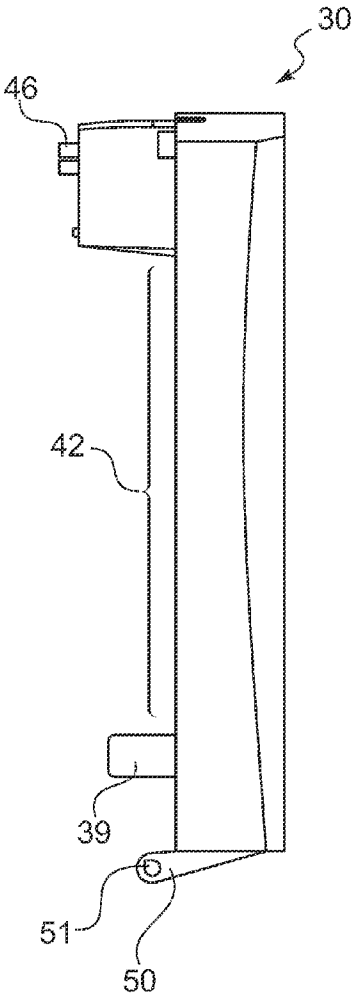
FIG. 7 shows a side plan view of the back plate of FIG. 5.
Figure 6:
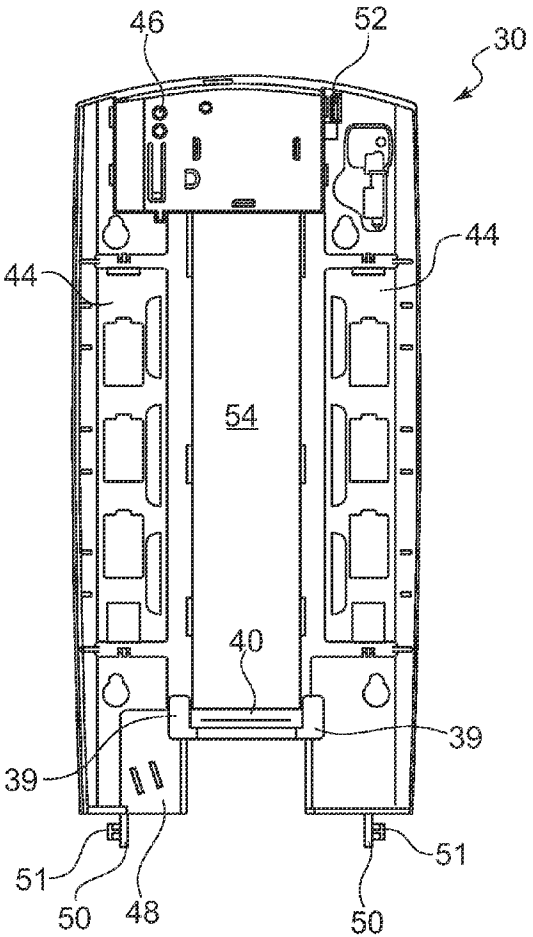
FIG. 6 shows a front plan view of the back plate of FIG. 5.
Figure 5:
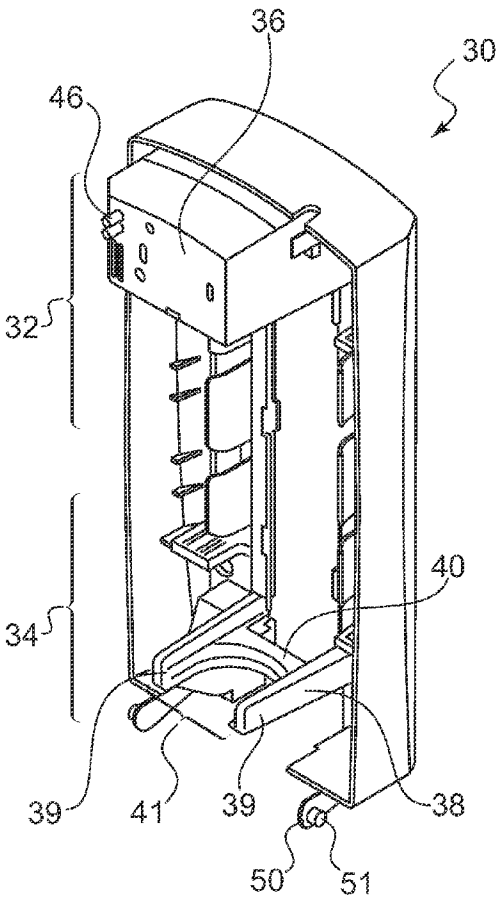
FIG. 5 shows a side perspective view of a back plate according to one dispenser embodiment.

FIGS. 5-7 show various views of one embodiment of a back plate 30. Back plate 30 generally has an upper portion 32 and a lower portion 34. At upper portion 32 is motor housing compartment 36. This compartment 36 is configured to house a motor in use. At lower portion 34 is bottle rest 38. Bottle rest 38 is configured to provide a surface against which a bottle may be positioned and rest for use in the dispenser 10. As shown in FIG. 5, soap bottle rest 38 may be two ledges 39 that jut from the back area of back plate 30, joined by a curved seat 40.

Figure 14:
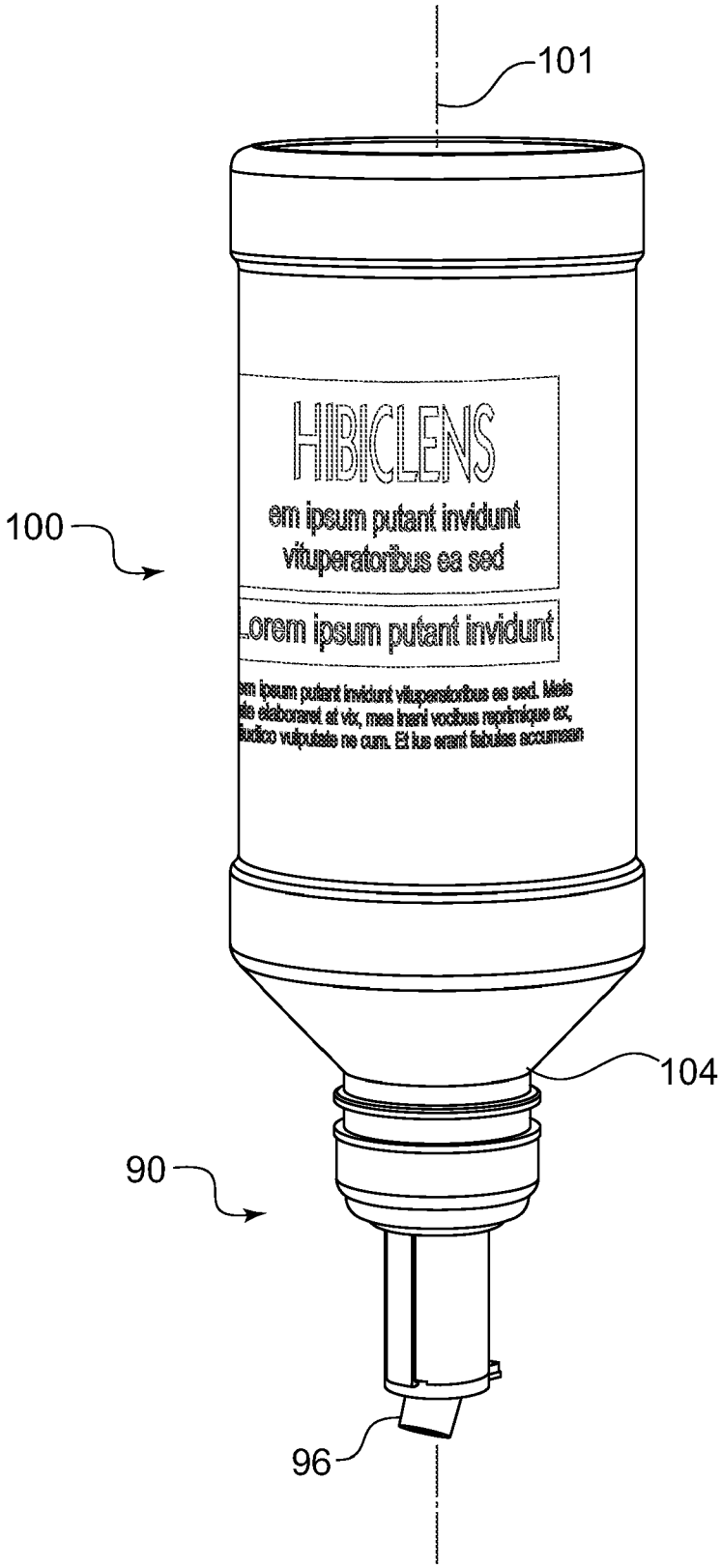
FIG. 14 shows one example of a soap bottle having a foam pump attached for use in connection with various dispenser embodiments.

An open area 41 between the ledges 39 allows for easy loading of a soap bottle 100 having an attached foam pump 90 (for example, as shown in FIG. 14). The soap bottle/foam pump may be loaded into the rest 38 by simply inserting the soap bottle/foam pump straight back into the open area 41 and allowing it to sit against curved seat 40. The foam pump receiving end of the bottle may be positioned so that it faces downwards and the mouth area 104 of the soap bottle may rest directly against the ledges 39 and be supported by the curved seat 40. Such an open soap bottle rest 38 configuration allows soap bottles of various sizes to be used with dispenser 10. Although not shown, it is possible for soap bottle rest 38 to be provided as a completely circular rest (without an open area) into which a soap bottle and attached foam pump may be inserted from the top down.

Prior to insertion of the soap bottle, however, when the front cover 12 and the back plate 30 are in a closed position, they collectively provide an open, soap bottle containing space 42. Space 42 is formed in part by an open space behind front cover 12 and open space of back plate 30. Along the center area of the back plate 30, there is defined a further central open space 54, which is configured to receive and house an actuator 60, discussed further below.

Alongside the central open space 54 are provided housing areas 44. Although housing areas 44 are shown along both sides of the back plate 30, it should be understood that only one area 44 may be provided. Housing areas 44 are primarily intended to house batteries or other powering components, but it should be understood that areas 44 may be used for housing components other than batteries.

One or more power indicators 46 may be provided on the back plate 30. Power indicators 46 are intended to alert the user that the dispenser 10 is currently being powered, for example, for notification and/or trouble shooting purposes. Power indicators 46 may be LED lights or any other appropriate indicator.

Located near the lower portion 34 of back plate 30 is a sensor 48. Sensor 48 is configured to sense a user's hand or body part below the soap dispenser and to activate the soap dispensing sequence described further below. Sensor 48 may be any appropriate type of sensor. In a specific embodiment, the sensor is an infrared sensor that detects the presence of a target, such as a user's hands.

If the front cover 12 and back plate 30 are provided as hingedly connected, back plate 30 is provided with a hinge connector 50 that corresponds to the hinge connector 18 of the front cover 12. In the embodiment shown, the back plate hinge connector 50 is a tab 51 that protrudes out from an arm extending from lower portion 34 of back plate 30. The corresponding hinge connector 18 of the front cover 12 has a tab receiving opening 19. It should be understood that the tab 51 and tab receiving opening 19 may be switched and that other hinge connections are possible and within the scope of this invention.

Upper portion 32 of back plate 30 has a lock connector 52. In the embodiment shown, the back plate lock connector 52 is an opening that is configured to receive the corresponding lock connector 20 of the front cover 12, which is formed as a tab. It should be understood that the opening and the tab may be switched and that other securement mechanisms to ensure secure attachment of the front cover to the back plate are possible and within the scope of this invention.

As shown in the back plan view of FIG. 8, back cover 30 may also have one or more wall mounts 58. Wall mounts 58 are provided in order to allow the dispenser to be secured in place to a wall or other surface, preferably near a sink and faucet system. Although dispenser 10 is primarily designed for dispensing a foamed hand soap, dispenser 10 may also be used to dispense an antibacterial or other type of cleaning substance to a user's hand, and may thus be positioned anywhere appropriate.

Figure 11:
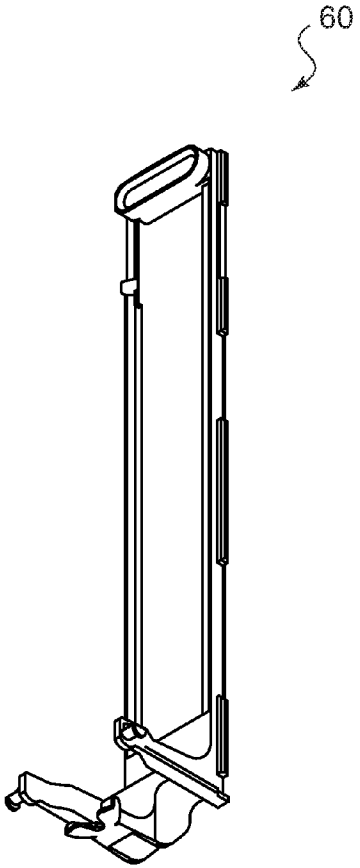
FIG. 11 shows a side perspective view of the actuator of FIG. 9.
Figure 10:
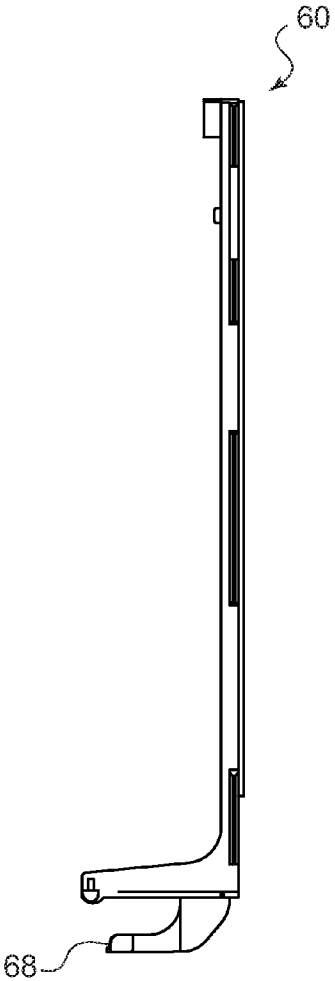
FIG. 10 shows a side plan view of the actuator of FIG. 9.
Figure 9:
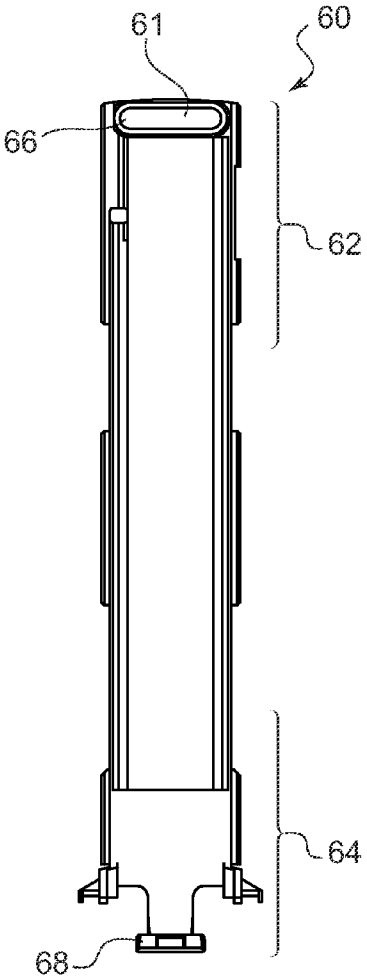
FIG. 9 shows a front plan view of an actuator according to one dispenser embodiment.

FIGS. 9-11 show various views of one embodiment of an actuator 60. Actuator 60 is provided as a connection between a motor located at the upper portion 32 of the back plate 30 (in the motor housing compartment 36) and the soap bottle dispensing mechanism, which in most instances, will be a foam pump 90. Actuator 60 is designed so that the motor can be located at the top of the dispenser 10, even though the foamed soap or other dispensed substance exits the dispenser 10 at the bottom. One advantage to providing a dispenser with such an actuator 60 is that it allows the primary motor system to be located at the top of dispenser, rather than at the bottom. Problems with locating the motor system at the bottom of the dispenser (so that it can directly activate the foam pump) are that it either requires that the soap bottle intended for use with the dispenser be specially designed so that it fits properly within the dispenser or it requires the dispenser to extend too far from the wall, causing clumsiness and possibly a violation of health regulations. However, providing the actuator 60 as a connection between the motor system and the foam pump (or other dispensing feature) solves both of these problems.

As shown in FIG. 9, actuator 60 has an upper portion 62 and a lower portion 64. Upper portion 62 has a motor cooperating feature 66 that allows actuator 60 to be coupled to or otherwise cooperate with a moving part of motor. Lower portion 64 has a pump cooperating feature 68 that allows actuator 60 to be coupled to or otherwise cooperate with a foam pump attached to a soap bottle. The motor may be a battery powered electric motor, or it may be wall-powered, or powered by any other appropriate source. When the motor moves, it causes the actuator 60 to correspondingly move due to interaction between the motor and the motor cooperating feature 66. When the actuator 60 moves, it activates the foam pump due to interaction between the pump cooperating feature 68 and the foam pump. Actuator 60 may be a piece of solid molded plastic (as shown), which can help lend structural rigidity to the system. Alternatively, it may simply comprise a ladder-type device, having sides with rungs running between the sides or cross-hatchings located between the sides in a x-shaped pattern. A further option is to provide actuator with a complete open area between two side bars.

In the specific embodiment shown, the motor cooperating feature 66 is an open area 61 at the upper portion 62. This open area 61 is adapted to receive and cooperate with crank 80 (shown in FIGS. 12 and 13). As the motor rotates, it causes the crank 80 to rotate, pulling the actuator 60 up and then allows it to fall.

Figure 12:
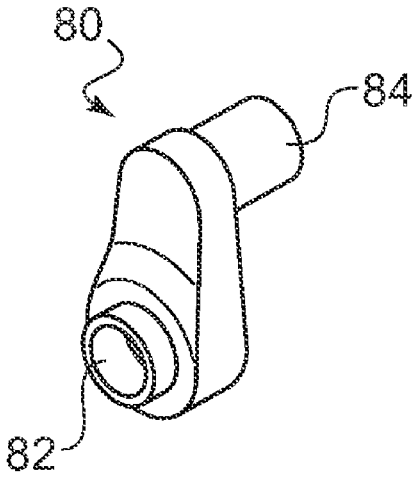
FIG. 12 shows a perspective view of a crank according to one dispenser embodiment.
Figure 13:
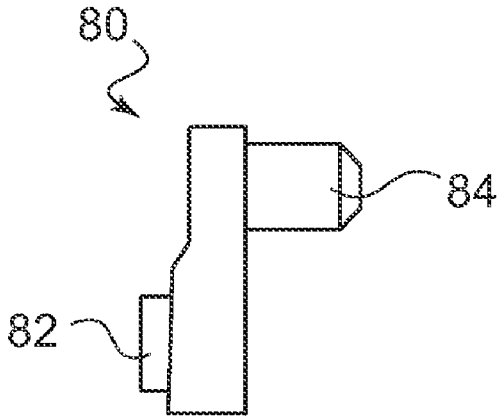
FIG. 13 shows a side plan view of the crank of FIG. 12.

A specific embodiment of crank 80 is shown in FIGS. 12 and 13. A motor connection area 82 on crank 80 connects to the motor and spins on a central shaft of the motor. An actuator connector 84 on crank 80 cooperates with the motor cooperating feature 66 of actuator 60. In the specific embodiment shown, the connector 84 fits into the open area 61 of the actuator. The action of the motor causes the connector 84 to apply upward pressure to the actuator 60, causing the actuator 60 to move upwards as well. When the actuator 60 moves upwards, it applies an upward pressure on the soap bottle/foam pump for dispensing, as described further below.

Embodiments of the dispensers 10 described herein are particularly useful with a pre-existing soap bottle. For example, as shown in FIG. 14, a soap bottle 100 having its opening aligned with the central axis 101 of the bottle (as most pre-existing bottles are designed) can be used, without causing the dispenser to extend too far from the wall. This is primarily because the motor is located at the top of the dispenser rather than at the bottom, as is the case with typical designs. (With previous designs, the soap bottle opening had to be forwardly offset so that the bottle opening could be positioned slightly forward to account for the machinery that had to be located behind the bottle mouth area 104.) However, the novel actuator design described herein allows for the use of pre-existing soap bottles, such as those having a centrally located opening, allowing the customer more flexibility in choosing which products or brands to use. The soap bottles used in connection with the dispensers described are typically rigid (i.e., non-collapsible) soap bottles.

In one specific embodiment, the soap bottle is shipped with a cap in order to safely contain the soap or other product contained therein. Once ready for use, the cap is removed and a foam pump 90 may be positioned over the mouth of the bottle. (If a foamed soap is not desired, then some other dispensing attachment may be secured to the mouth of the bottle.) The bottle is then inverted and positioned in the soap bottle containing space 42 of the dispenser, such that the mouth of the bottle faces downward and/or portions of the foam pump 90 rest on and extend through the bottle rest 38, as shown in FIG. 1.

The foam pump cooperating feature 68 of the actuator 60 is configured to receive or otherwise cooperate with a dispensing end 96 of the foam pump 90. When the actuator 60 is pulled upwards by the crank and motor, feature 68 presses up on the dispensing end 96, causing the foam pump to activate. Although any type of foam pump engine may be used, one particularly useful foam pump is manufactured and designed by Rieke Packaging Systems™.

Figure 15:
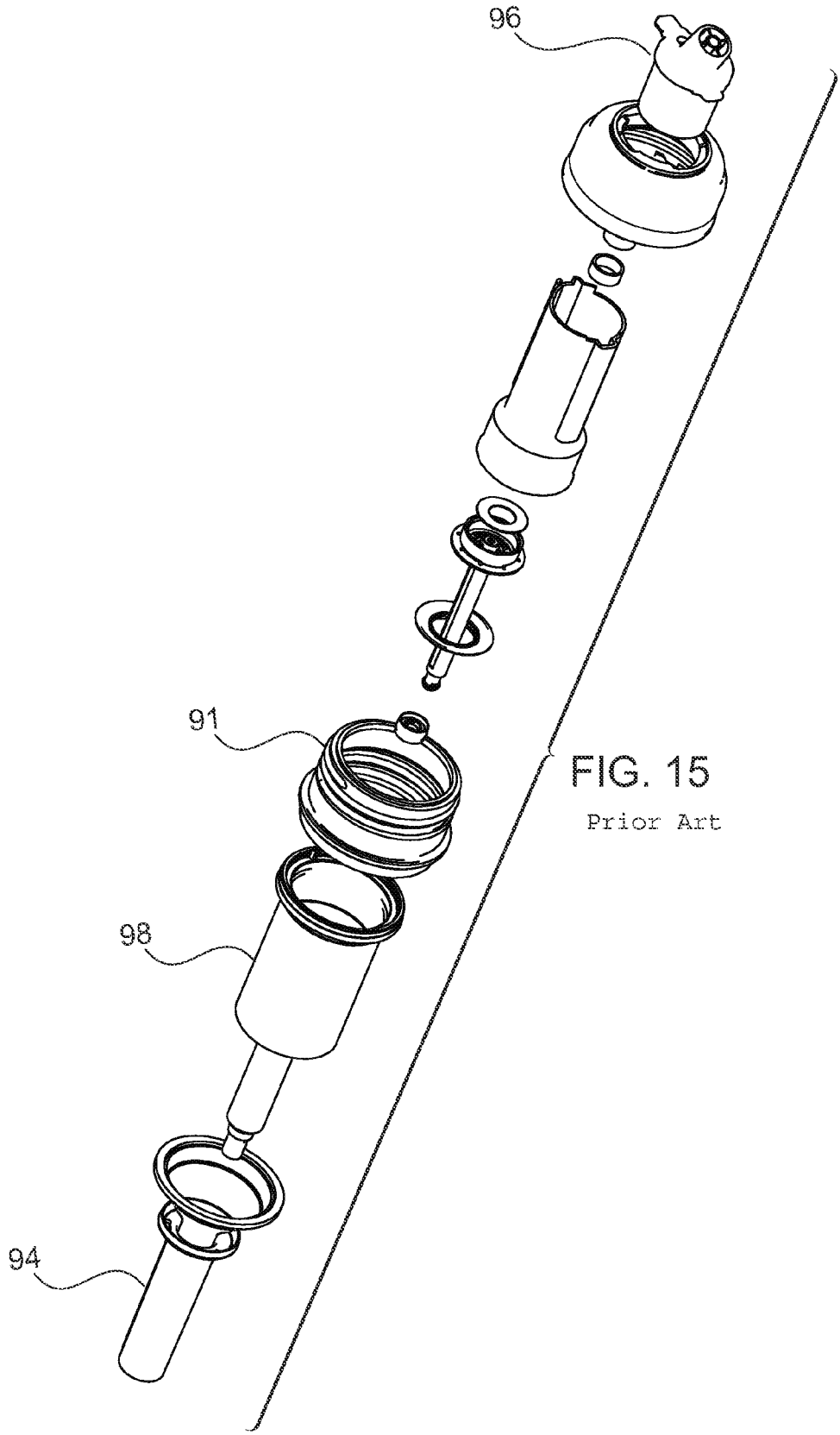
FIG. 15 Prior Art
FIG. 15 shows a blown apart view of one embodiment of a foam pump that may be used in connection with various dispenser embodiments.
Figure 16:
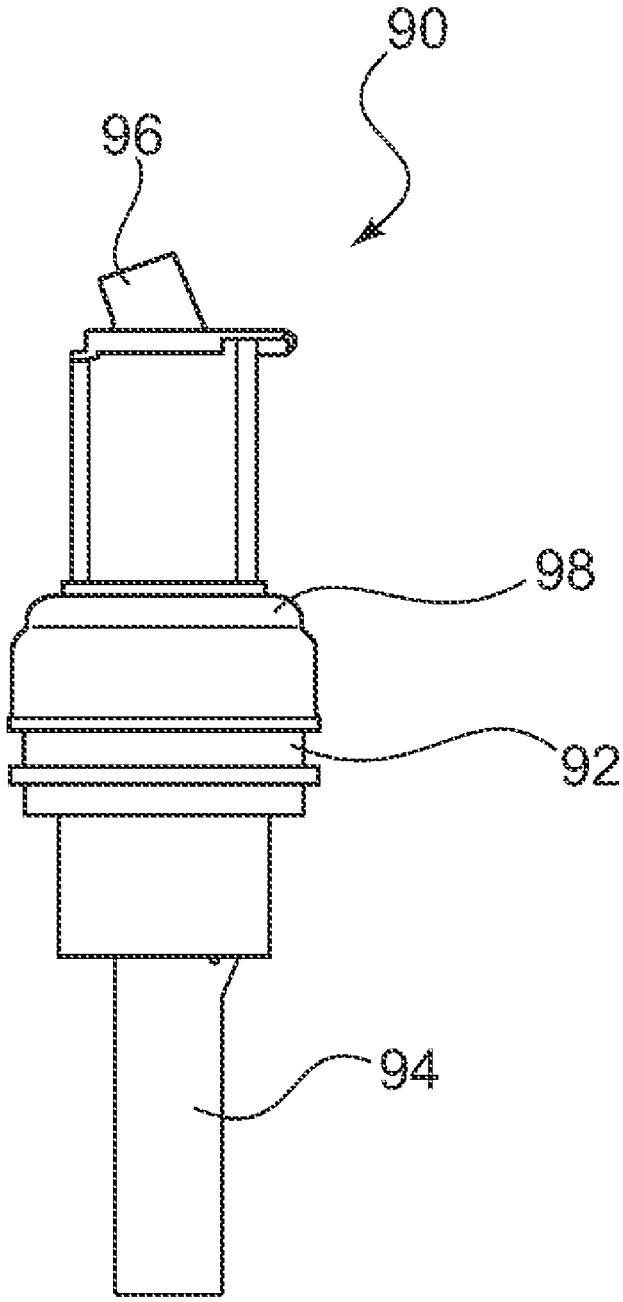
FIG. 16 Prior Art
FIG. 16 shows an assembled view of the foam pump of FIG. 15.

More specifically, examples of useful foam pumps are shown in FIGS. 15 and 16. Although FIG. 15 shows a blown apart view of a foam pump, this is for illustration purposes only. The foam pump supplied by Rieke Packaging Systems™ is provided as a complete unit. Once ready for use, the foam pump 90 is attached to a soap-filled bottle 100. One method for securing the foam pump to the bottle is for the two elements to be threadably engaged. They may be directly engaged, or, in instances when the thread on the bottle does not directly match the thread of the selected foam pump, it is useful to use an adapter ring 92 having external threads 91. As shown in FIGS. 15 and 16, the adapter ring 92 may have two threaded areas, one area that matches the threads of the bottle to be used, and one area 91 that matches the threads of the foam pump to be used. When the bottle is inverted, as shown in FIG. 14, and the foam pump is activated, liquid soap is drawn from the bottle into the foam engine 98 via an integrally molded siphon 94. The liquid soap enters the base of the siphon, and travels up the siphon and into the top of the foam engine 98. Activation of the foam engine 98 forces liquid soap and air through a thin mesh (not shown) in the foam pump, creating foam, which is expelled through the dispensing end (or nozzle) 96 of the foam pump (e.g., through the nozzle) and onto the user's hand(s).

In order to allow the pressure on the inside of a rigid soap bottle to equalize with outside conditions, air may pass into the bottle via air gaps at the sides of nozzle 96, allowing air to be drawn back through the gaps and into the soap bottle.

As previously discussed, the motor is activated by an infrared sensor which detects the presence of an object (i.e., a hand) and custom designed electronics control the number of motor rotations. The number of rotations and the volume of the liquid dispensed into the foam engine chamber of the foam pump can be varied to determine the final volume of foam dispensed per activation. In one specific embodiment, the dispenser is configured to dispense three shots of foam (i.e., the actuator is raised three times in quick succession) within about a 1.5 second period in order to deliver a specific amount of foam to the user's hand(s).

Changes and modifications, additions and deletions may be made to the structures and methods recited above and shown in the drawings without departing from the scope or spirit of the invention and the following claims.

What is claimed is:

1. A dispenser, comprising:

a front cover;

a back plate; and an actuator;

wherein the front cover and the back plate define a bottle containing space;

wherein the back plate comprises a motor housing compartment located above a bottle and a bottle rest at its lower portion;

wherein the actuator extends the length of the bottle, comprising a motor cooperating feature at its upper portion and a pump cooperating feature at its lower portion, wherein the actuator is received on the back plate for upward and downward movement of the actuator relative to the back plate, wherein cooperation between a motor and the motor cooperating feature of the actuator causes movement of the actuator so as to move the pump cooperating feature towards and away from the bottle rest, thereby activating the pump of the bottle.

2. The dispenser of claim 1, wherein the dispenser is a foamed soap dispenser.

3. The dispenser of claim 1, wherein the actuator is configured to activate a foam pump.

4. The dispenser of claim 3, wherein the actuator has an actuator tongue that presses up on a dispensing end of the foam pump in order to activate the pump and dispense foam.

5. The dispenser of claim 1, wherein the front cover is hingedly attached to the back plate.

6. The dispenser of claim 1, wherein the bottle is a soap bottle configured to be positioned in the bottle containing space and rest against the bottle rest of the back plate.

7. The dispenser of claim 6, wherein the soap bottle is a rigid bottle.

8. The dispenser of claim 1, further comprising a motor configured to be housed in the motor housing compartment of the back plate.

9. The dispenser of claim 1, wherein the back plate further comprises one or more housing areas.

10. The dispenser of claim 1, further comprising a sensor configured to sense a user's hand or body part below the dispenser.

11. The dispenser of claim 10, wherein the sensor is located on the back plate.

12. The dispenser of claim 1, further comprising a foam pump configured to be secured to a soap bottle, wherein when the soap bottle is inverted and positioned in the soap bottle containing space, the foam pump cooperating feature of the actuator cooperates with the foam pump.

13. The dispenser of claim 1, wherein the front cover comprises one or more clear windows configured to allow a user to view one or more internal features of the soap dispenser.

14. The dispenser of claim 1, wherein the front cover comprises a recessed area configured to receive a soap bottle label.

15. A method for automatically dispensing a substance onto a user's hand, comprising:

(a) providing a dispenser comprising: a front cover, a back plate, and an actuator, wherein the front cover and the back plate define a bottle containing space, wherein the back plate comprises a motor housing compartment located above a bottle and a bottle rest at its lower portion, wherein the actuator extends the length of the bottle, and comprises a motor cooperating feature at is its upper portion and a pump cooperating feature at its lower portion, wherein the actuator is received on the back plate for upward and downward movement of the actuator relative to the back plate, wherein cooperation between a motor and the motor cooperating feature of the actuator causes movement of the actuator so as to move the pump cooperating feature towards and away from the bottle rest, thereby activating the pump of the bottle, wherein the dispenser further comprises a sensor configured to sense the user's hand below the dispenser;

(b) providing a bottle containing the substance to be dispensed, with an optional foam pump secured thereto;

(c) inverting the bottle; and (d) positioning the bottle in the dispenser, such that when the user's hands are positioned below the dispenser, the sensor senses the presence of the user's hands and causes the dispenser to automatically dispense the substance thereon.

16. A dispenser, comprising:

a front cover;

a back plate; and an actuator;

wherein the front cover and the back plate define a bottle containing space;

wherein the back plate comprises a motor housing compartment located above a bottle and a bottle rest at its lower portion;

wherein the actuator is received on the back plate for upward and downward movement of the actuator relative to the back plate, wherein the actuator extends the length of the bottle, comprising a motor cooperating feature at is upper portion, the motor cooperating feature comprising an open area configured to cooperate with a motor crank, and a pump cooperating feature at its lower portion, the pump cooperating feature comprising a tongue configured to press up on a dispensing end of a pump, wherein cooperation between a motor crank and the motor cooperating feature of the actuator causes upward movement of the actuator such that the pump cooperating feature of the actuator presses up on and activates a pump.

17. A method for automatically dispensing a substance onto a user's hand, comprising:

(a) providing a dispenser comprising: a front cover, a back plate, and an actuator, wherein the front cover and the back plate define a bottle containing space, wherein the back plate comprises a motor housing compartment located above a bottle and a bottle rest at its lower portion, wherein the actuator extends the length of the bottle, and is received on the back plate for upward and downward movement of the actuator relative to the back plate, wherein the actuator comprises a motor cooperating feature at is upper portion, the motor cooperating feature comprising an open area configured to cooperate with a motor crank, and a pump cooperating feature at its lower portion, the pump cooperating feature comprising a tongue configured to press up on a dispensing end of a pump, wherein cooperation between a motor crank and the motor cooperating feature of the actuator causes upward movement of the actuator such that the pump cooperating feature of the actuator presses up on and activates a pump, wherein the dispenser further comprises a sensor configured to sense a user's hand below the dispenser;

(b) providing a bottle containing the substance to be dispensed, with an optional foam pump secured thereto;

(c) inverting the bottle; and (d) positioning the bottle in the dispenser, such that when a user's hands are positioned below the dispenser, the sensor senses the presence of the user's hands and causes the dispenser to automatically dispense the substance thereon.

* * * * *